US005213412A

United States Patent [19]

Ciallella

[11] Patent Number: 5,213,412

[45] Date of Patent: May 25, 1993

[54] DROP LIGHT WITH MAGNET AND HOOK

[76] Inventor: Bruce Ciallella, 795 May Ave., Perth Amboy, N.J. 08861

[21] Appl. No.: 772,149

[22] Filed: Oct. 7, 1991

[51] Int. Cl.[5] ..... F21V 21/08

[52] U.S. Cl. ..... 362/398; 362/396; 362/399; 362/400

[58] Field of Search ..... 362/226, 368, 369, 376, 362/378, 396, 398, 399, 400, 430, 310

[56] References Cited

U.S. PATENT DOCUMENTS

| | | | |
|---|---|---|---|
| 1,405,221 | 1/1922 | Jenkins | 362/398 |
| 2,678,228 | 5/1954 | Gerharot | 362/398 |
| 2,747,079 | 5/1956 | Kubiliunas | 362/398 |
| 2,825,799 | 3/1958 | Julien | 362/226 |
| 3,809,883 | 5/1974 | Goodwin | 362/376 |
| 4,470,106 | 9/1984 | Norton | 362/430 |
| 4,727,462 | 2/1988 | Komonko | 362/398 |

FOREIGN PATENT DOCUMENTS

| | | | |
|---|---|---|---|
| 1039703 | 10/1978 | Canada | 362/400 |
| 1254867 | 1/1961 | France | 362/398 |
| 84447 | 12/1964 | France | 362/398 |

*Primary Examiner*—Ira S. Lazarus
*Assistant Examiner*—Y. Quach
*Attorney, Agent, or Firm*—Ezra Sutton

[57] ABSTRACT

An improved lamp hanger for hanging portable utility lamps which includes a lift plate affixed to an exterior surface of the lamp having a magnet disposed therein. A selectively removable cap fits onto and grips the lift plate for covering the magnet and includes a hook projecting from a surface thereof in a direction away from the lamp when the cap is in place on the lift plate and provides a means for hanging the lamp from a hook point. Alternatively, the cap can be removed and the lamp suspended by the magnet from a ferromagnetic surface.

4 Claims, 2 Drawing Sheets

DROP LIGHT WITH MAGNET AND HOOK

BACKGROUND OF THE INVENTION

The present invention relates to a utility light for illuminating a work area and more particularly, to a drop light having a magnet and a hook for suspending it.

DESCRIPTION OF RELATED ART

Electric utility lamps having an extension cord have been known for many years. Lamps of this type typically have a handle for holding an electric socket, an on/off switch, and a bulb guard for surrounding and protecting an incandescent bulb that is threaded into the socket. The bulb guard usually has a solid shade/reflector portion and a light penetrable grate portion hinged to the shade portion which permits the guard to be opened and the bulb to be changed. Ordinarily, lamps of this sort include a hook projecting from the top of the bulb guard for hanging the lamp from a suitable support in the work environment. In view of the unavailability, in certain environments, of a suitable support for receiving the lamp hook and the frequent presence of ferromagnetic substrates in the environment, certain magnetic equivalents to the conventional hook have been proposed. U.S. Pat. No. 4,672,515 to Baker, for example, proposes the attachment of a magnet to the side of the shade portion of a conventional drop lamp via a rotatable link. U.S. Pat. No. 4,564,894 to Gonzalez employs a plurality of magnets attached around the exterior of the shade portion of a utility lamp. U.S. Pat. No. 4,369,487 to Carlow teaches a side mounted combination cord spool and associated magnet for affixing to ferromagnetic surfaces. U.S. Pat. No. 2,987,612 to E. M. Haulter shows a magnet mounted to the top of a utility lamp guard and further includes a pivoting hook to allow either magnetic or mechanical suspension. No known device, however, provides a drop lamp with a simple, injection moldable, top mounted, hook or magnet selectable, suspender unit.

SUMMARY OF THE INVENTION

The problems and disadvantages associated with the conventional techniques and devices utilized to illuminate a work area with a suspendable drop lamp are overcome by the present invention which includes a lamp hanger for suspending a lamp. The lamp hanger has a lift plate affixed to an exterior surface of the lamp and includes a magnet disposed within the lift plate. A selectively removable cap fits onto and grips the lift plate for covering the magnet and includes a hook projecting from a surface thereof in a direction away from the lamp when the cap is in place on the lift plate.

BRIEF DESCRIPTION OF THE FIGURES

For a better understanding of the present invention, reference is made to the following detailed description of an exemplary embodiment considered in conjunction with the accompanying drawings, in which.

DESCRIPTION OF THE PREFERRED EMBODIMENTS

Figure 1:
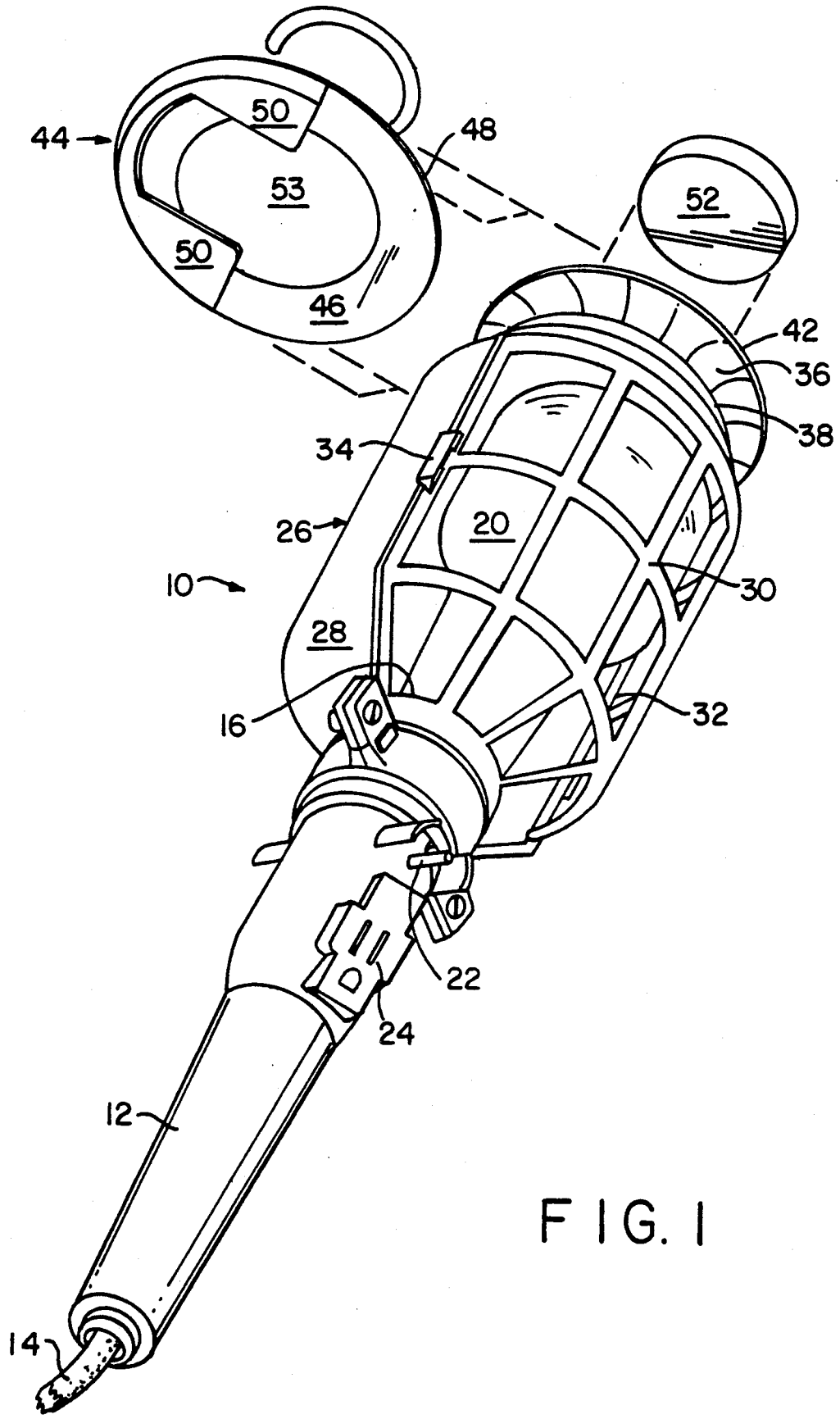
FIG. 1 is an exploded perspective view of a drop lamp constructed in accordance with an exemplary embodiment of the present invention viewed from a position closest to the handle portion of the device and looking towards the shade portion.

Referring to FIG. 1 there is shown a utility or drop lamp 10 having a handle 12 The handle receives an electric wire or extension cord 14 at one end, which supplies electricity to an incandescent light socket 16, disposed at an opposite end of the handle. The light socket 16 receives therein an incandescent lamp bulb 20. The handle 12 further includes a switch 22 for turning the light on and off. An electric receptacle 24 is provided for receiving the plug (not shown) of an electrical appliance (not shown) which is to be powered from the electricity flowing through the extension cord 14. A bulb shroud or guard 26 is secured to the socket end of the handle 12 by clamp bolts or other suitable means and shields the bulb from breakage in the eventuality the lamp 10 is dropped. The bulb guard 26 also prevents the user from inadvertently touching a hot incandescent bulb 20. As the guard 26 is intended to receive and absorb shocks, it is preferably manufactured of a resilient material such as plastic. The bulb guard 26 has a shade portion 28 for shielding the user's eyes from the light emitted by the bulb 20 and a light permeable cage or grate portion 30 which permits light to exit the bulb guard and impinge upon the work area. The grate portion 30 is hingedly connected to the shade portion 28 on one side by a hinge 32 and secured closed by a latch 34 opposite the hinge, the latch 34 and hinge 32 permitting access to the interior of the bulb guard 26 for changing bulbs 20. Each and all of the foregoing components are conventional and well known in the art.

Referring further to FIG. 1, it can be seen that the conventional drop lamp 10 depicted has been improved by the inclusion of a lift plate or suspender disk 36 affixed to the top of the bulb guard 26 at a position distal to the handle 12 via an interposed stem 38 affixed to and projecting away from the top of the shade portion 28 of the bulb guard 26. The stem 38 terminates at its other end in the disk 36 which has an outer peripheral rim 42. A hook cap 44 having a base plate 46 with a peripheral flange 48 extending downwardly therefrom is shown in an exploded position to the left side of the disk 36. A pair of retainer flanges 50 extend downwardly from the peripheral flange 48 and project inwardly parallel to the base plate 46. A magnet 52 is depicted in an exploded position between the hook cap 44 and the suspender disk 36. An additional magnet 53 may be provided in the hook cap 44 such as by gluing it to the underside thereof for increasing the hold of the hook cap to the suspender disk 36. The additional magnet 53 in the hook cap 44 may also be used to suspend the hook cap 44 from a suitable metallic substrate for the purpose of serving as a cord guide, that is for holding the electric supply cord 14 powering the light 10 to keep it out of the way and to support the weight of the cord. Although a fixed stem 38 has been shown and described, it could as well be slideably mounted within a track extending from the top of the shade portion 28 distal to the handle 12 to the side of the shade portion, or gimbel mounted, thereby enabling the suspender disk 36 to be displaced from its position at the top of the light to the side thereof to permit the light to be supended with the grate portion 30 pointing down, thus directing more light in a downward direction than if the light were suspended from the top of the shade portion 28.

Figure 2:
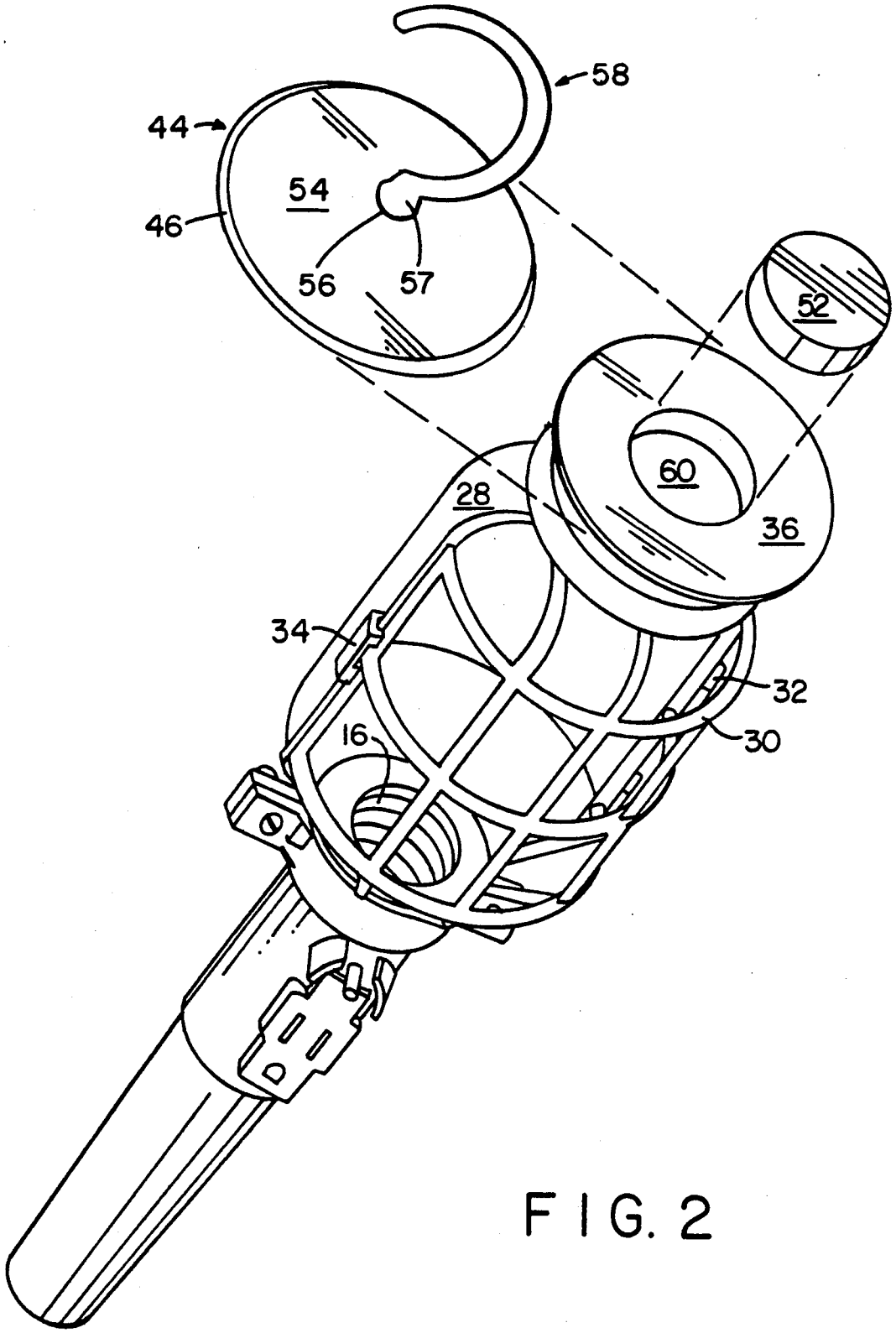
FIG. 2 is an exploded perspective view of a drop lamp constructed in accordance with an exemplary embodiment of the present invention viewed from a position closest to the shade portion of the device and looking towards the handle portion.

Referring to FIG. 2 the hook cap 44 includes a dome-shaped hook plate 54 extending from the periphery of the hook cap and converging to a center opening 56 for receiving the shank 57 of a suitably sized hook 58. Of course, the hook plate need not be dome shaped and could be, for example, a strap or handle-like member. The hook 58 may be pivotally secured within the center opening 56 to permit swiveling. As previously depicted in FIG. 1, the magnet 52 is shown in an exploded position between the hook cap 44 and the suspension disk 36. A recess 60 is provided in the center of the disk 36 for receiving the magnet 52, where it is glued in place or retained by other conventional means, such as by tabs formed around the upper peripheral edge of the recess 60. Although a button-shaped magnet is shown, the invention could be practiced with a magnet of any shape.

Again referring to FIGS. 1 and 2, the cooperation between the hook cap 44 and suspender disk 36 and means of making the device will be further explained. The hook cap 44 of the present invention is preferably formed of a semi-rigid plastic compound such as an injection molded carbon-based polymer. The hook plate 54 is formed having a suitable center opening 56 into which the hook 58 is inserted and retained by, for example, melting and mushrooming the shank 57 to prevent its withdrawal. Alternative means for retaining the hook 58 could be employed, such as, a threaded hook shank 57 held in association with the hook plate 54 by a threaded nut. The hook plate 54 is merged to the base plate 46 by plastic welding techniques or by gluing, although it is equally possible to injection mold both as a unit. As it is necessary that the retaining flanges 50 in the embodiment shown be elastic to permit the hook cap 44 to be slid into position on suspender disk 36, they are preferably formed from injection molded plastic. It is also desirable to simultaneously form the shade 28, stem 38 and suspender disk 36 by an injection molding process. While it would be possible to form and assemble each of the foregoing parts in say, sheet metal, it would be more expensive. In certain situations, however, the expense may be justified if an especially sturdy lamp is required. The hook cap 44 is installed on the suspender disk 36 by inserting an edge of the outer peripheral rim 42 of the disk 36 into the space between the retainer flanges 50 and the base plate 46 and pressing the respective pieces into coaxial alignment. The peripheral flange 48 is dimensioned relative to the suspender disk 36 to approximate the thickness of the disk 36 and to slideably coaxially receive the disk 36 within the recess defined by the peripheral flange 48. As the space between the retainer flanges 50 and the base plate 46 approximates the thickness of the suspender disk, the flanges 50 must deform to permit the disk 36 to find its seat within and embraced by the peripheral flange 48. The elastic memory of the retainer flanges 50 holds the hook cap 44 in association with the suspension disk 36. Alternative means for removably retaining the hook cap 44 in association with the suspender disk 36, such as, utilizing a single semi-circular retainer flange 48 and a hook cap 44 having a living hinge proximate the centerline of the cap to permit deformation to allow disk 36 entry into the retainer flange 48 as well as numerous other equivalent strategies are within the grasp of the normal artisan.

Thus, if the user of the drop light 10 is in an environment having a suitable support to serve as a convenient hook point, the hook cap 44 is retained in place on the lamp and the hook used to suspend it. It should be observed that the hook may be rotatable within the central opening and/or the hook cap may be slideably rotatably retained on the suspender disk, both means of freedom of rotation allowing the direction of light projection to be adjusted as needed. In the eventuality that no convenient hook point is available at the work site, but there is a metal surface available, the hook cap 44 can be removed by manipulating it under hand pressure thereby deforming the retainer flanges 50 sufficiently to permit it to be withdrawn from the suspender disk 36. The magnet 52 retained within the magnet recess 60 of the suspender disk 36 is exposed upon removal of the hook cap 44 and permits the lamp to be removably affixed to any convenient ferromagnetic surface. Due to the location of the magnet 52 at the top of the lamp 10, it is possible to adjust the projection direction of the light produced by the lamp as it is held by its magnet. It is desirable to provide a flexible cable or rope affixed to the hook cap 44 and the lamp 10 to prevent the cap from becoming lost. Although only the typical drop lamp has been discussed herein, the selectable hook or magnet suspension feature could be applied to any light such as, for instance, a battery powered flashlight which would, therefore, fall within the scope of the present invention.

Thus it should be appreciated that the present invention provides a simple, adjustable, suspendable drop lamp which is either held by magnetic force or by a hook as desired by the user and to suit the requirements of the work environment. The suspension means is top mounted, conveniently formed by injection molding, and is retrofitable to existing drop lamp units. It should be understood that the embodiments described herein are merely exemplary and that a person skilled in the art may make many variations and modifications without departing from the spirit and scope of the invention as defined in the appended claims.

What is claimed is:

1. A lamp holder in combination with a removable work holder for holding tools and workpieces, comprising:

a) a housing for receiving a lamp;

b) a first magnet mounted on said housing for attaching said housing to a surface having a magnetic attraction to said first magnet;

c) a work holder removably mounted on said housing;

d) said work holder including a hook member for hanging said housing from a suitable surface;

e) said work holder further including a second magnet for attaching said work holder to a surface having a magnetic attraction to said second magnet so that said hook member may be used to suspend tools and workpieces; and f) wherein said work holder has a first surface and a second surface and wherein said hook member is rotatably mounted on said first surface and said second magnet is mounted on said second surface and wherein said second surface includes means for slidably and removably mounting said work holder on said housing.

2. A lamp holder in accordance with claim 1, wherein said work holder, when mounted on said housing, covers said first magnet.

3. A lamp holder in accordance with claim 1, wherein aid first magnet is mounted on one end of said housing.

4. A lamp holder in accordance with claim 1, wherein said first magnet is mounted on said housing to be aligned with and coact with said second magnet in said work holder so that the attraction between said first and second magnets operates to hold said work holder on said housing.

* * * * *